US007481860B2

(12) United States Patent
Ivarsson

(10) Patent No.: US 7,481,860 B2
(45) Date of Patent: Jan. 27, 2009

(54) CYCLONIC SEPARATOR FOR SUCTION CLEANER

(75) Inventor: Bengt Ivar Anders Ivarsson, Ma Wan (HK)

(73) Assignee: VAX Limited, Worcestershire (GB)

( * ) Notice: Subject to any disclaimer, the term of this patent is extended or adjusted under 35 U.S.C. 154(b) by 562 days.

(21) Appl. No.: 11/273,094

(22) Filed: Nov. 14, 2005

(65) Prior Publication Data

US 2006/0179801 A1 Aug. 17, 2006

(30) Foreign Application Priority Data

Feb. 15, 2005 (GB) ..... 0503072.1

(51) Int. Cl.
*B01D 45/12* (2006.01)

(52) U.S. Cl. ..... 55/346; 55/349; 55/429; 55/DIG. 3; 96/381; 96/382

(58) Field of Classification Search ..... 55/337, 55/346, 349, 394, 429, DIG. 3; 96/380, 381, 96/382

See application file for complete search history.

(56) References Cited

U.S. PATENT DOCUMENTS

| | | | | |
|---|---|---|---|---|
| 5,078,761 | A | 1/1992 | Dyson | |
| 5,125,127 | A | 6/1992 | Bach et al. | |
| 5,135,552 | A | 8/1992 | Weistra | |
| 5,351,362 | A | 10/1994 | Kramer et al. | |
| 5,500,979 | A | 3/1996 | Wörwag | |
| 5,960,514 | A | 10/1999 | Miller et al. | |
| 6,058,559 | A | 5/2000 | Yoshimi et al. | |
| 6,350,292 | B1 | 2/2002 | Lee et al. | |
| 6,572,668 | B1 | 6/2003 | An et al. | |
| 6,662,403 | B2 | 12/2003 | Oh | |
| 7,291,189 | B2 * | 11/2007 | Lim et al. | 55/337 |
| 2002/0011053 | A1 | 1/2002 | Oh | |
| 2002/0062632 | A1 | 5/2002 | Oh | |
| 2002/0088078 | A1 | 7/2002 | Oh et al. | |
| 2002/0120998 | A1 | 9/2002 | Dubos et al. | |
| 2002/0124538 | A1 | 9/2002 | Oh et al. | |
| 2003/0106182 | A1 | 6/2003 | Lee | |

(Continued)

FOREIGN PATENT DOCUMENTS

| | | | |
|---|---|---|---|
| DE | 38 34 686 | C1 | 12/1989 |

(Continued)

OTHER PUBLICATIONS

Pending U.S. Appl. No. 11/187,414, filed Jul. 22, 2005, 23 pages.

(Continued)

*Primary Examiner*—Robert A Hopkins
(74) *Attorney, Agent, or Firm*—Michael Best & Friedrich LLP

(57) ABSTRACT

A cyclonic separator/collector device for a suction cleaner, comprising a housing and at least one cyclonic separator disposed within the housing, the or each cyclonic separator having a cyclone body with a circumferential wall of which at least a major part is spaced from the housing; the space between the housing and wall of the cyclone body(s) receiving separated dust from the cyclonic separator(s); wherein the space between the cyclone body and the housing includes a sound-insulating material. The arrangement provides sound insulation for the cyclonic separators.

8 Claims, 5 Drawing Sheets

U.S. PATENT DOCUMENTS

2003/0106183 A1 6/2003 Frederick et al.

FOREIGN PATENT DOCUMENTS

| | | | | |
|---|---|---|---|---|
| DE | 94 20 797.6 | U1 | | 7/1995 |
| DE | 299 00 460 | U1 | | 8/2000 |
| DE | 199 14 574 | C1 | | 11/2000 |
| DE | 101 10 771 | A1 | | 9/2002 |
| EP | 1 386 573 | A2 | | 2/2004 |
| FR | 2 425 227 | | | 12/1979 |
| GB | 2 128 075 | A | | 4/1984 |
| GB | 2 367 510 | A | | 4/2002 |
| JP | 2004135700 | | * | 5/2004 |
| WO | WO 98/35602 | A1 | | 8/1998 |
| WO | WO 2004/049887 | A1 | | 6/2004 |
| WO | WO 2004/049889 | | | 6/2004 |
| WO | WO 2004/049890 | A1 | | 6/2004 |
| WO | WO 2004/052166 | A1 | | 6/2004 |

OTHER PUBLICATIONS

Pending U.S. Appl. No. 11/217,584, filed Aug. 31, 2005, 17 pages.
Pending U.S. Appl. No. 29/240,051, filed Oct. 7, 2005, 6 pages.
Pending U.S. Appl. No. 29/240,115, filed Oct. 7, 2005, 6 pages.
Pending U.S. Appl. No. 29/240,116, filed Oct. 7, 2005, 5 pages.
Pending U.S. Appl. No. 29/240,117, filed Oct. 7, 2005, 7 pages.
Pending U.S. Appl. No. 29/240,118, filed Oct. 7, 2005, 7 pages.
Pending U.S. Appl. No. 10/537,537, filed Nov. 14, 2005, 21 pages.
Pending U.S. Appl. No. 10/537,381, filed Nov. 14, 2005, 25 pages.
Pending U.S. Appl. No. 10/537,382, filed Nov. 14, 2005, 33 pages.
Pending U.S. Appl. No. 10/537,481, filed Nov. 14, 2005, 14 pages.
Pending U.S. Appl. No. 11/329,194, filed Jan. 10, 2006, 23 pages.
Pending U.S. Appl. No. 11/375,722, filed Mar. 15, 2007, 16 pages.

* cited by examiner

CYCLONIC SEPARATOR FOR SUCTION CLEANER

This invention relates to a cyclonic separator/collector device for a suction cleaner (vacuum cleaner).

BRIEF SUMMARY

Cyclonic separator/collector devices are well known in suction cleaners. A flow of air having dirt, dust and other matter (all herein referred to as dust) entrained therein, drawn from whatever is being cleaned by a source of suction (a motor and impeller) in the cleaner, passes through the separator in which the air is caused to pass through a cyclone, body in a generally helical path so that the dust is separated from the air flow by centrifugal forces. The separated dust is collected and retained in a part of, or associated with, the cyclone body for emptying, and disposal, when it is convenient.

Cyclonic separator/collector devices are useable in suction cleaners of both the upright type and the cylinder type. In the former, the separator generally is provided in a body part of the cleaner extending upwardly from, and usually pivotably connected to, a cleaning head, the body having a handle at its upper end by which a user can maneuver the entire machine over a floor surface being cleaned. The latter type of machine has a body, containing the separator, which is moveable over a surface such as a floor surface, and from which a flexible suction hose extends to a wand and/or cleaning head or tool. The invention is, in principle, applicable to suction cleaners of both types. A number of cyclonic separation stages may be utilized, and/or post-separator (pre-motor) filters may be provided to ensure that as much dust as possible is removed form the flow of air and no, or substantially no, dust is contained in air discharged from the cleaner. Efficient operation of a cyclonic separator requires high-speed air flow through it, so that the centrifugal action by which the dust is separated from the air flow is maximised. However, high speed air flow in a cyclonic separator can be very noisy, and the noise can include high-frequency sounds which are at least irritating to a user of a cleaner.

It is broadly the object of the present invention to address the problem of noise created by the operation of a cyclonic separator.

According to the present invention, we provide a cyclonic separator/collector device for a suction cleaner, comprising a housing and at least one cyclonic separator disposed within the housing, the or each cyclonic separator having a cyclone body with an outer circumferential wall of which at least the major part is spaced from the housing; the space between the housing and wall of the cyclone body(s) receiving separated dust from the cyclonic separator(s).

In a separator/collector device in accordance with the invention, the spacing of the circumferential wall of the or each cyclone body from the housing of the separator/collector substantially reduces the transmission of noise, generated by the air flow within the cyclone body(s), to the exterior of the cleaner. For minimising noise transmission, all or substantially all of each cyclone wall may be thus spaced.

There may be two cyclonic separators disposed within the housing, connected in parallel with one another so that half the total air flow through the separator/collector device passes through each cyclonic separator. Such cyclonic separators will of course be smaller than a single one of the same capacity, which enables higher air speeds within the cyclonic separators to be achieved, and consequently more efficient separation of dust from the air flow.

A further advantage of the invention is that whilst the cyclone bodies themselves need to be of predominantly circular cross-sectional shape, either cylindrical or tapering, the shape of the housing does not have to conform to such a shape or shapes. If the housing forms part of the visible surface of a suction cleaner when the separator/collector assembly is in situ, there is considerable freedom to shape the housing to suit the overall styling of the cleaner. In other words, the styling of the cleaner is not constrained by the cylindrical or tapering shape of the cyclone body or bodies of the separator.

A lower part of the housing, relative to the disposition of the cyclonic separator(s) therein, may provide for collection and retention of dust separated from the suction air flow in use. When we refer to orientations, or to positions or directions such as a lower part, we do so with reference to the normal intended orientation of the suction cleaner for use. An operable door in the housing may provide for disposal of such collected dust.

Other parts of the space between the cyclone body(s) and housing may fulfil other functions. For example, they may provide a path or paths for flow of air to and/or from the separators. Since such flows do not in general involve such high air speeds as the helical flow within the cyclone body(s), they are less likely to generate unacceptable noise levels than the flow in the or each cyclonic separator itself, which are of course sound-insulated by the space between it or them and the housing.

If not required for air flow purposes, a part or parts of the space between the or each cyclone body and the housing may contain a substance giving greater sound insulation that that if the space just contained air; for example such a substance may be a foamed plastics or rubber material, or a textile wadding.

According to another aspect of the invention, we provide a suction cleaner provided with a cyclonic separator/collector device according to any one of the preceding claims, the device being removeably mounted in relation to a body of the cleaner.

A part or parts of the housing of the separator/collector device preferably forms part of the visible exterior surface of the cleaner. Thus such part or parts may be shaped in accordance with the styling of the cleaner.

BRIEF DESCRIPTION OF THE DRAWINGS

These and other features of the invention will now be described by example with reference to the accompanying drawings, of which.

DETAILED DESCRIPTION OF THE PREFERRED EMBODIMENTS

Figure 1:
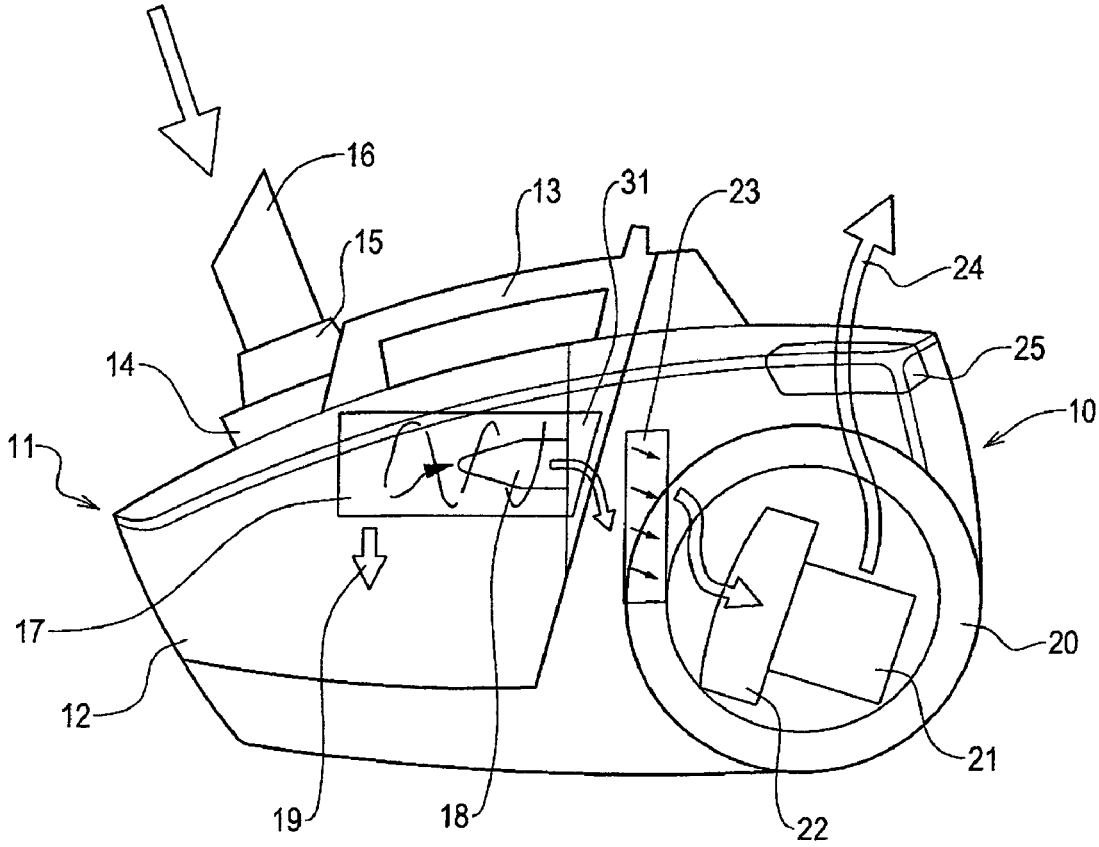
FIG. 1 is a diagrammatic side elevation of a suction cleaner in accordance with the invention.

Referring firstly to FIG. 1 of the drawings, there is illustrated, in diagrammatic side elevation, a suction cleaner comprising a body part 10 and a dust separator/collector assembly indicated generally at 11. The separator/collector assembly 11 fits in relation to the body 10 of the cleaner by occupying a recess at the end of the latter, being retained therein for use by fastening means not shown and being removable therefrom for emptying of collected dust. The separator/collector assembly 11 comprises an exterior housing 12 defining an interior space, the housing having a carrying handle 13 by which it can be held when fitting it in relation to or removing it from the body 10 of the cleaner, and when dust is being emptied from the housing. The housing 12 has a formation 14 for connection of a suction hose cuff 15, the other end of the hose 16 having a fitting for connection to a cleaning tool or head by way, if required, of a wand.

The body 10 of the cleaner, which has a pair of wheels 20 for facilitating moving of the cleaner over a floor surface, contains a source of suction, namely an electric motor 21 and impeller 22. A passage for the suction airflow created by the source of suction leads to the impeller 22 from a pre-motor filter 23. Following the impeller 22, exhaust air is released to the surrounding atmosphere as indicated at 24, by way of a post-motor filter 25.

The housing 12 contains at least one cyclonic separator 17 and, in the described embodiment, two thereof, disposed alongside one another and connected, in air flow terms, in parallel with one another as described in greater detail hereafter. A passage within the housing 12 provides for suction air flow to reach inlets of the cyclonic separators, while air from which dust has been removed by the cyclonic separators leaves them at an exit passage 31 which when the housing is in situ in the body of the cleaner, faces and has sealing engagement with an entry passage to the pre-motor filter 23.

Figure 2:
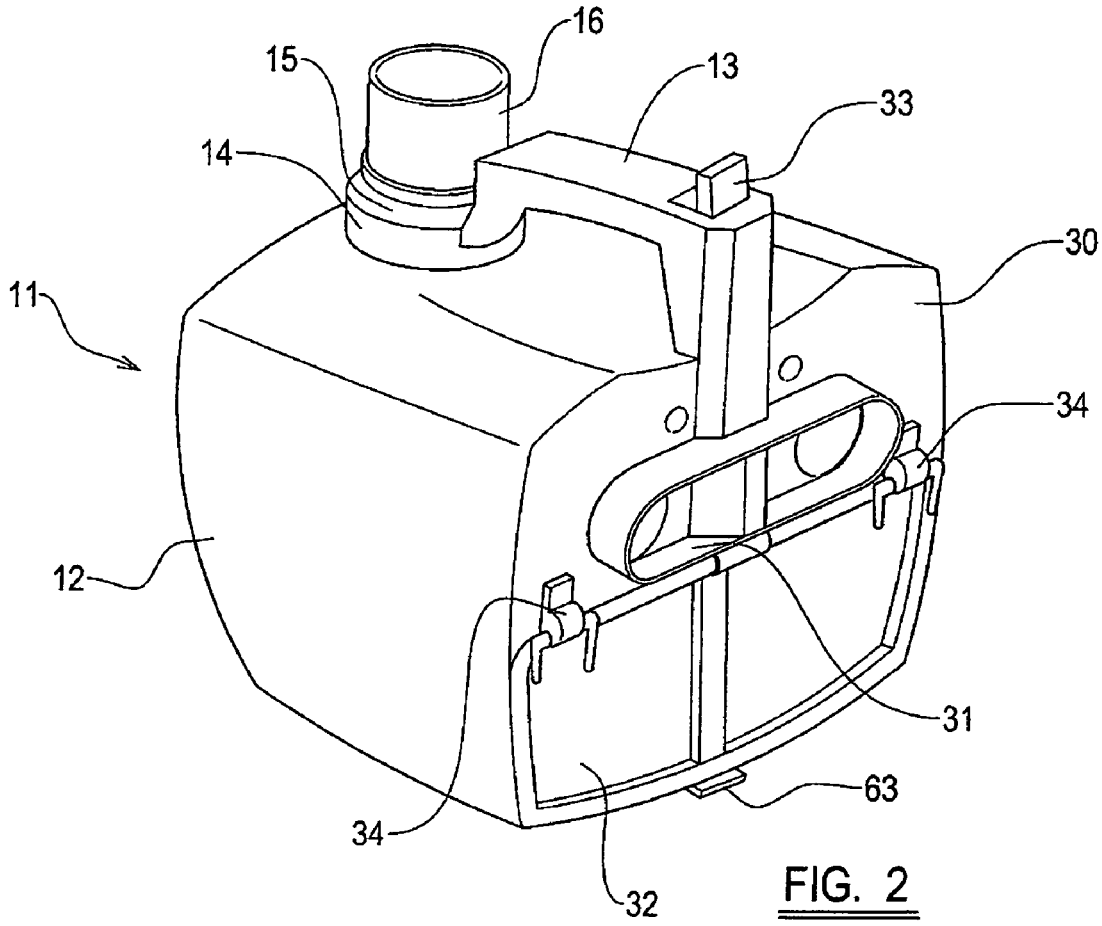
FIG. 2 is a perspective view of the dust separator/collector assembly of the cleaner of FIG. 1.

Referring now to FIG. 2 of the drawings, this shows in a perspective view the separator/collector assembly 11. Clearly visible, on the top of the housing 12 of the assembly 11, is formation 14 for hose connection by cuff 15. Also visible in FIG. 2 are the handle 13 on the housing 12, and an end wall 30 of the housing which faces the part of the body 10 of the cleaner containing the source of suction and the pre-filter 23, the wall 30 having an exit passage 31 for air to flow from the cyclones within the housing 12 to the pre-filter 23. A door 32, openable to give access to the interior of the housing 12 for emptying collected dust therefrom, forms a lower part of the end wall 30.

Figure 3:
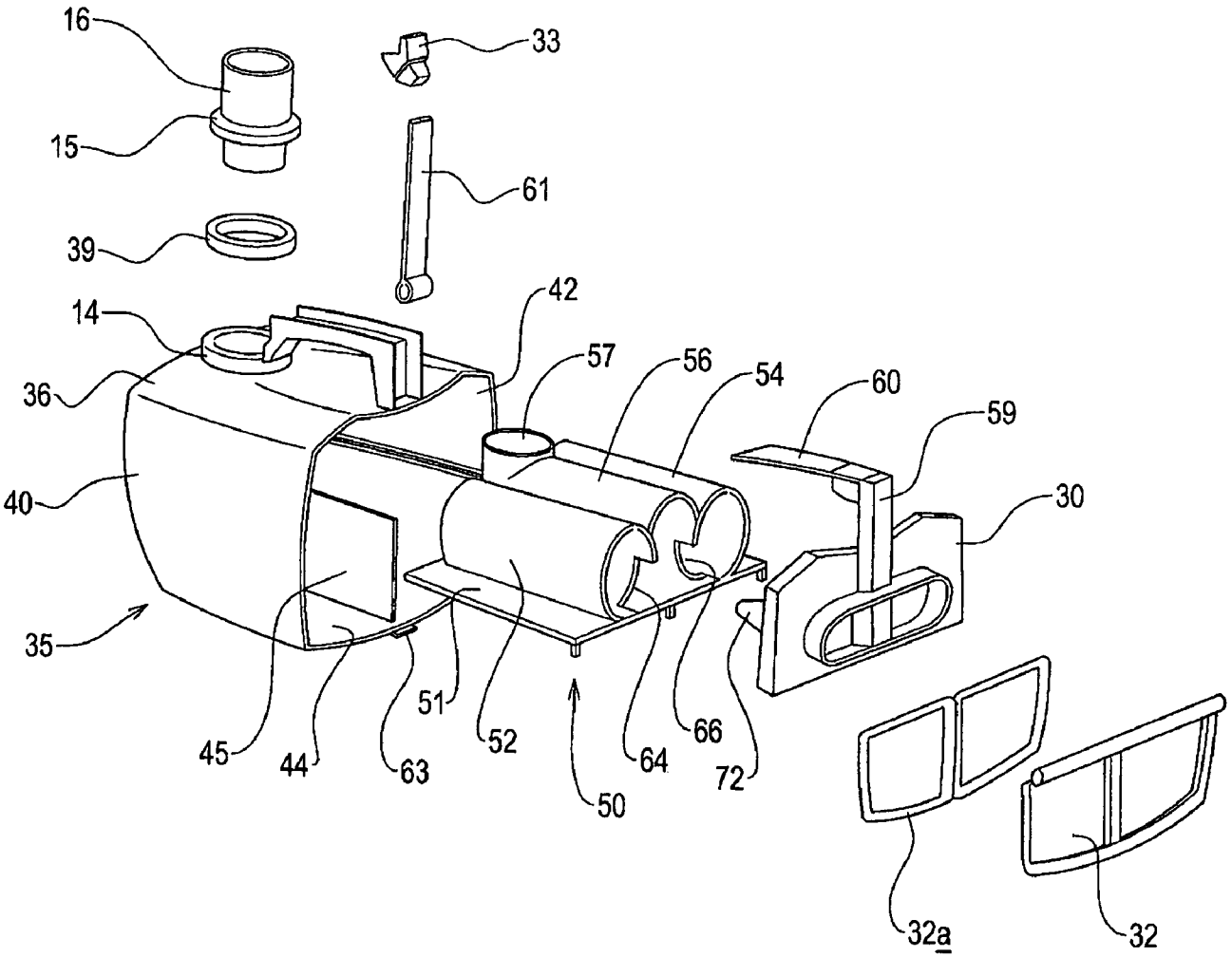
FIG. 3 is an exploded perspective view of the dust separator/collector assembly.
Figure 4:
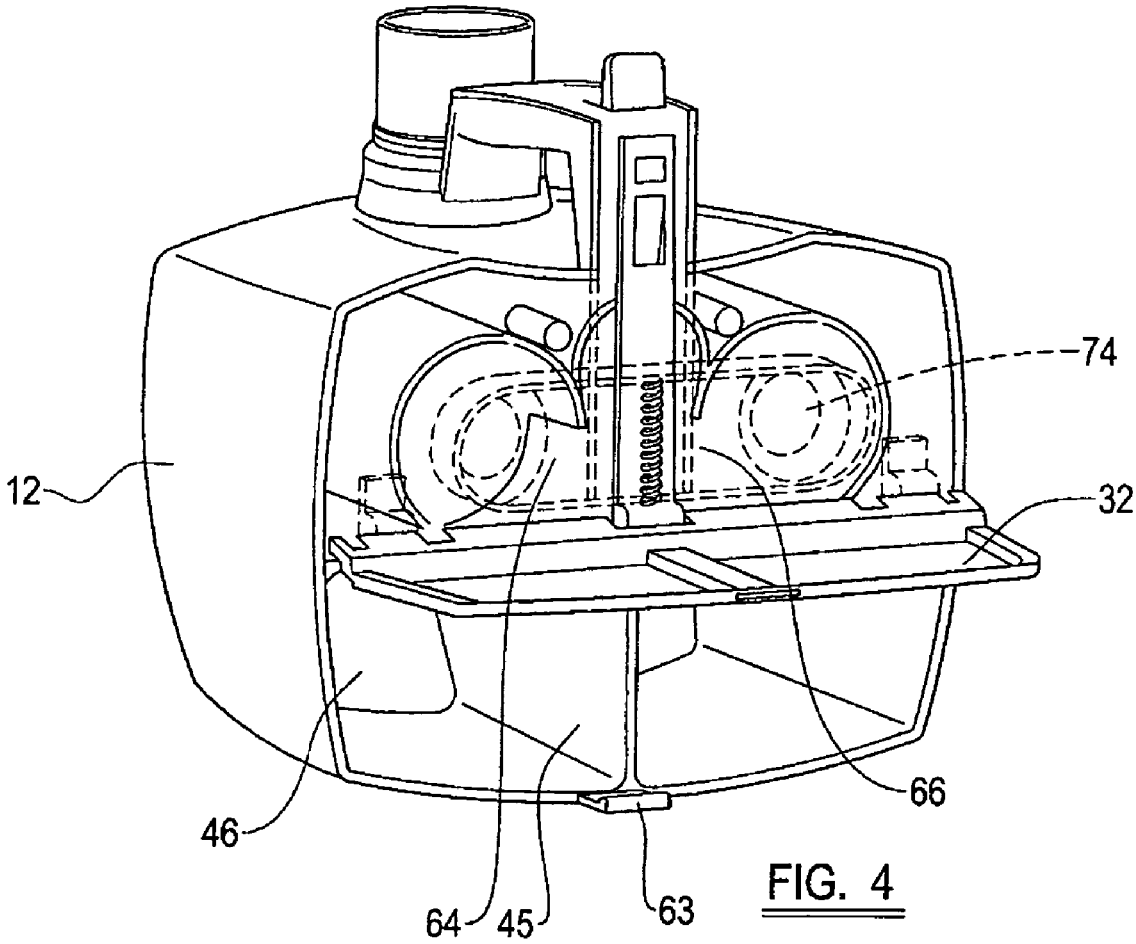
FIG. 4 is a perspective view, with some parts in outline, showing the interior arrangement of the dust separator/collector assembly.
Figure 5:
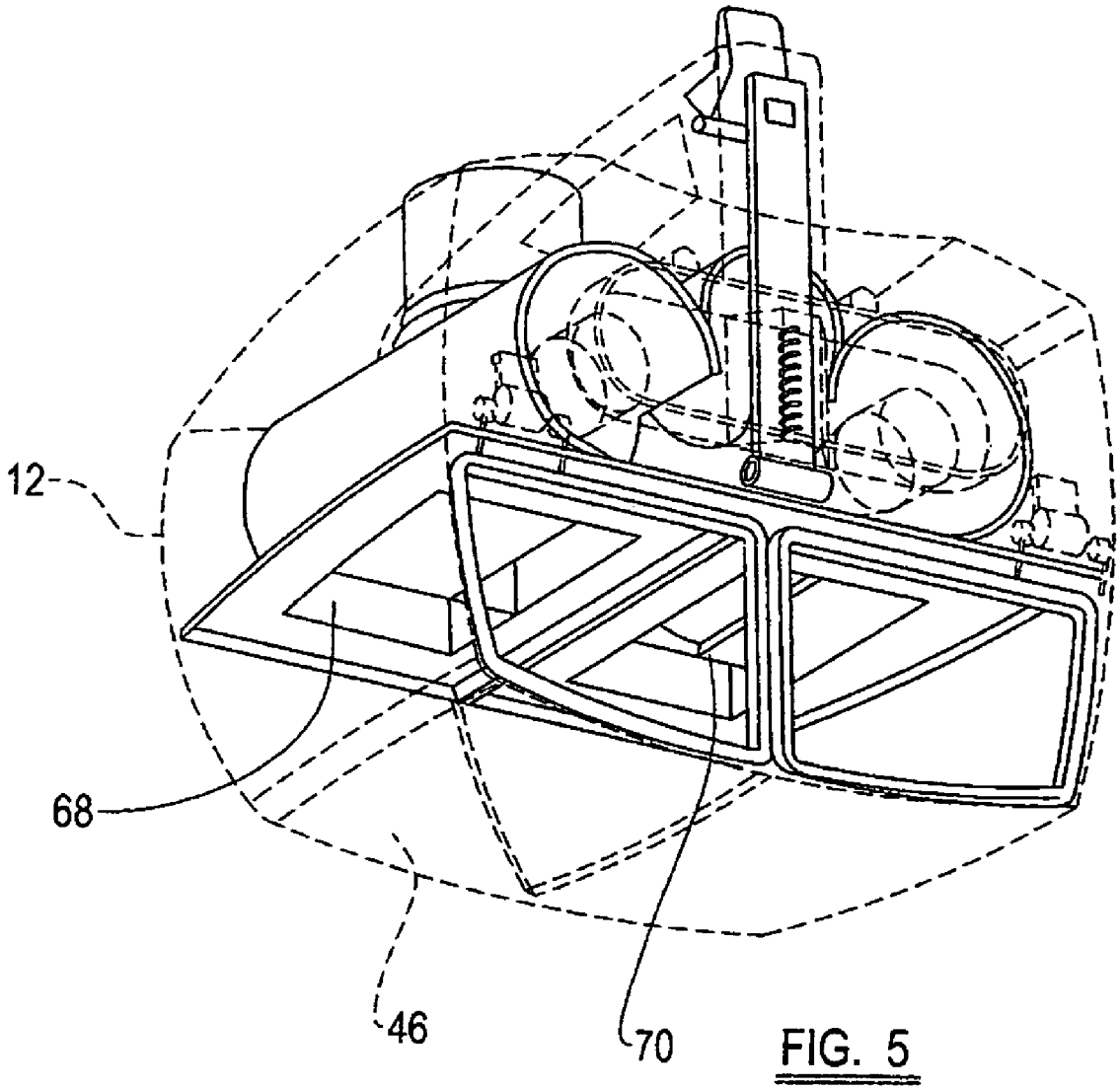
FIG. 5 is a view as FIG. 4, but from a different viewpoint.

Referring now to FIGS. 3, 4 and 5 of the drawings, these show in more detail the components of the separator/collector assembly 11. The door 32 is pivotably connected to the end wall 30, the pivoting connections 34 providing for some movement of the door as a whole upwardly and downwardly relative to the end wall 30 in addition to the pivoting thereof, to enable the door 32 to be released from a catch 63 when it is to be opened, as described in greater detail hereafter. The pivoting connections 34 of the door incorporate springs which bias the door downwardly into engagement with its catch, and also bias it pivotably to open to a position (shown in FIG. 4) in which it lies generally perpendicular to the wall 30. A release button 33 is provided at the end of the handle 13, for releasing the door 32 from the catch which holds it closed, enabling the door to pivot open under spring action when emptying is to be carried out.

The housing 12 has a box-like main component indicated at 35 in FIG. 3; which has a top wall 36 having a handle part 37, and a hollow boss 38 which affords the formation 14 to which the hose cuff 15 is fittable with the intermediary of a seal 39. The housing further comprises side walls 40, 42 and a bottom wall 44, from which a central rib 45 extends upwardly to just under half the height of the housing. The front of the housing component 35 adjacent the boss 38, is closed by an upwardly extending front wall 46.

Within the housing component 35 a cyclone body member 50 is fitted. This body member comprises a plate part 51 which rests on the rib 45 and on supporting formations facing one another inside the side walls 40, 42 and on the front wall. The plate 51 seals against the side walls and front wall. The plate 51 carries two parallel cyclone bodies 52, 54 whose circumferential walls are cylindrical and between them a tubular part 56 which ends in a right angle bend 57 facing upwardly to align with the hollow boss 38. The parts 56, 57 define a passage for flow of air from the boss 38 to inlet openings of the respective cyclone bodies 54, 52.

With the cyclone body member 50 in situ within the housing component 35, end wall 30 closes the open end of the housing. The end wall 30 has a somewhat L-shaped part extending therefrom, comprising an upwardly extending limb 59 and laterally extending limb 60 which fit to respective portions of the handle part 37 to close the front and top parts thereof, retaining the release button 33 therein. An operating rod 61 extends downwardly within the part 59 to engage the door 32, so that the door is able, when the button 33 is operated, to be pulled upwardly at its pivotal connections to the end wall 30. This releases the door 32 from catch 63 at the centre of the bottom wall 44, adjacent the rib 45, so that the door pivots open under the action of its springs. When the door 32 is closed, a seal 32*a* carried thereby seals against end faces of the plate part 51, rib 45, side walls 40, 42 and bottom wall 44.

The end wall 30 closes the open ends of the cyclone bodies 52, 52 and the tubular part 56 between them. Openings between the cyclone bodies 52, 54 and the end of the tubular part 56 provided inlet openings leading into the interior of the cyclone bodies; these inlet openings are indicated at 64, 66 respectively. At the opposite ends, the cyclone bodies having openings 68, 70 respectively for allowing dust separated in the cyclone bodies to fall (as indicated by arrow 19 in FIG. 1) into the lower parts of the housing 12, beneath the plate 51 and separated from one another by the rib 45.

The end wall 30 further carries cyclone exit members which are in the form of conical parts having lengthways slots, extending into the interior of the two cyclone bodies from their open ends. The disposition of the exit members indicated at 18 if FIG. 1. Part of one of the exit members is seen in FIG. 3 at 72 and part of the other is seen in FIG. 4 at 74. These connect with the air exit passage 31.

Thus, the air flow through the entire separator/collector assembly is through the hose cuff 15 and boss 14, and a tubular part 56 into the two cyclone bodies by way of the inlet openings 64, 66 through which the air flows air flows are caused to enter the cyclone bodies tangentially to follow a helical path therein causing entrained dust to be separated under centrifugal forces. Air from which such dust has been removed leaves the cyclonic separators by way of the two exit members and the passage 31, to flow to the pre-filter 23 and hence to the source of suction of the cleaner and to be exhausted to the external atmosphere.

It will be noted that the cyclone bodies 52, 54 and the tubular part 56 between them are all spaced from the external walls of the housing 35. Hence, a substantial degree of sound insulation is achieved, so that the noise created by air flow to, within, and from the cyclones is less noticeable and annoying to a user of the cleaner. Where the space between the circumferential walls of the cyclone bodies and the housing is not required for reception of dust, sound insulation material may be provided.

When the separator/collector assembly 11 is fitted to the body 10 of the cleaner, the housing 12 of the former is visible and part thereof forms part of the exterior surface of the cleaner, being shaped to conform to the overall styling of the cleaner.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

The invention claimed is:

1. A cyclonic separator/collector device for a suction cleaner, comprising a housing and a first cyclonic separator disposed within the housing, the first cyclonic separator having a cyclone body with a circumferential wall that is positioned within the housing to form a space between the circumferential wall and the housing, the space receiving separated dust from the first cyclonic separator during operation of the suction cleaner; wherein the space between the cyclone body and the housing includes a sound-insulating material.

2. A separator/collector device according to claim 1 comprising a second cyclonic separator disposed within the housing, connected in parallel with the first cyclonic separator.

3. A separator/collector device according to claim 2 wherein the first and the second cyclonic separators are each disposed in a generally horizontal orientation within the housing.

4. A separator/collector device according to claim 3 wherein the housing includes a collection portion positioned below the first cyclonic separator and the second cyclonic separator wherein dust separated by the first and second cyclonic separators collects in the collection portion.

5. A separator/collector device according to claim 4 wherein the housing further comprises an end wall that includes an exit passage from the first and the second cyclone separators, and a pivotable door with a closed position wherein the dust collected within the housing part is retained within the housing, and an open position wherein the dust collected within the housing can be removed from the housing.

6. A separator/collector device according to claim 1 wherein the space between the first cyclone body and the housing provides a path for air flow through the cyclonic separator.

7. A separator/collector device according to claim 1, wherein the device is removeably mounted in relation to a body part of the suction cleaner.

8. A separator/collector according to claim 7 wherein a part of the housing forms part of an exterior surface of the suction cleaner.

* * * * *